United States Patent [19]

Borghorst

[11] 4,215,739

[45] Aug. 5, 1980

[54] OSCILLATING APPARATUS FOR STRAND CASTING MOLD

[75] Inventor: Friedhelm Borghorst, Duisburg, Fed. Rep. of Germany

[73] Assignee: Mannesmann Demag AG, Duisburg, Fed. Rep. of Germany

[21] Appl. No.: 36,404

[22] Filed: May 7, 1979

[30] Foreign Application Priority Data

May 20, 1978 [DE] Fed. Rep. of Germany ..... 2822138

[51] Int. Cl.[2] ..... B22D 11/04

[52] U.S. Cl. ..... 164/416; 74/25

[58] Field of Search ..... 164/83, 416; 74/25

[56] References Cited

U.S. PATENT DOCUMENTS 3,581,806 6/1971 Neumann et al. ..... 164/416

3,592,258 7/1971 Simons ..... 164/416

3,782,446 1/1974 Walter ..... 164/416

FOREIGN PATENT DOCUMENTS 2546689 4/1976 Fed. Rep. of Germany .

*Primary Examiner*—Robert D. Baldwin

*Attorney, Agent, or Firm*—Mandeville and Schweitzer

[57] ABSTRACT

Reciprocating apparatus is provided for a strand casting mold which is simplified and less expensive to produce. This is achieved by mounting the mold supports in resilient bearings, and reducing the length of the drive train from the drive motor to the rocker gear. Moreover, provision is made in the drive train of the invention for accommodating expansion and contraction caused by extreme temperature variations at the operating site.

18 Claims, 10 Drawing Figures

OSCILLATING APPARATUS FOR STRAND CASTING MOLD

BACKGROUND AND STATEMENT OF THE INVENTION

The invention refers to oscillating or reciprocating apparatus for a strand casting mold which is movable in a guide parallel with the strand vein and whose oscillatory movements are transmitted by means of rocking levers from a motor. This type of oscillating apparatus serves to loosen the liquid metal to be cast, particularly liquid steel, from the wall surfaces of the strand casting mold during the solidification process. In general, sinusoidal oscillatory motions or variations of the sine shape and/or variations of amplitude are provided for differential up and down movements.

The means producing the oscillatory motions consist generally of an electric motor driving an eccentric shaft connected to rocking levers. Due to the remote connection of the electric motor, there is a multitude of moving joints. All known oscillating devices use sprocket chains of considerable length. Of disadvantage in this type of apparatus is the great expenditure for the complicated lever gears and for the lever rotary gears, causing inaccuracies in the oscillatory path. In order to repeat exactly the required movements for the strand casting mold, accurately working lever gears are necessary.

The great number of parts also makes such oscillating and/or reciprocating devices very susceptible to disturbances; they are not easily accessible and difficult to service, and finally, they only offer a small degree of operating safety in the rough operation of a foundry. German Patent Publication DE-OS No. 25 46 689 shows an example of such an oscillating device.

Contrary to the prior art, the present invention provides an oscillating apparatus without the described disadvantages, which can function with very short sprocket chains, thus requiring little expenditure, and simultaneously, processing the characteristic of exactly maintained paths of motion and of operating with greatest possible safety. The invention solves this by providing the support points between the strand casting mold and/or the lift table carrying it and the rocking levers with elastic and/or resilient supporting elements surrounding the articulated axle, by providing as rocking levers two-arm levers pivoting around rotary axes, and by connecting these with the other lever arm on each strand side to draw and/or thrust rods joined to the rocker gear. Expenditure is primarily reduced on account of the hinging of the two-arm levers to one common draft element. Furthermore, the power transmission path starting at the rocker gear is considerably shortened. The shorter power transmission path, in turn, reduces the number of sources of error so that the paths of motion are maintained more accurately than heretofore.

The greatest degree of accuracy, however, is achieved by means of the supporting elements surrounding the articulated axle. The looseness or play occurring in known lever gears is prevented by means of the resilient supporting elements. The chain of power from the electric motor via a series gear with a following eccentric shaft can, therefore, be almost free of play during the entire oscillatory motion. Furthermore, it is advantageous that the elastic supporting elements permit heat expansion processes of the strand casting mold and/or lift table on which the mold is arranged, symmetrically with the strand axis, without exerting pressure on the casting strand.

Pressure resulting from lever pairs of uneven length for curved motions is eliminated by hinging an additional lever at a rocking lever pair on both sides of the strand vein between the lever carrying the elastic supporting element and the mold and/or lift table. A space-saving arrangement of the oscillating apparatus is achieved by providing toggle levers as two-arm rocking levers.

According to the basic concept of the invention, the oscillating or reciprocating apparatus is suitable for straight as well as curved strands. For curved strands, the lever arms carrying the elastic supporting elements are of even length within one pair, and the pairs are of differential lengths. Furthermore, it is advantageous that the draw and/or thrust rods next to the strand vein may be adjusted in length. This makes it possible to adjust, without play, the initial positions of the rocking levers with reference to the strand casting molds and/or with reference to the lift table carrying the strand casting mold.

According to another improvement of the invention aiming at a favorable power transmission path, the draw and/or thrust rods are hinged by means of joints to other draw rods and/or to the two-arm levers and to the rocker gear. For the adjustment of the two-arm rocking levers, it is also advantageous that in the draw and/or thrust rods provided in pairs each rod is adjustable in length. Another detail of the invention provides that the means for adjustment of the length of a draw and/or thrust rod consist of a turn-buckle, an expansion bolt or the like.

The accuracy of the lever system is also furthered by arranging the pillow blocks receiving the rotary axes for the rocking levers on a common supporting frame. The basic idea of this measure is to obtain an even greater accuracy, with respect to the symmetrical arrangement and thus the synchronism on each side of the strand vein. The parallelism of the rocking levers is also of considerable importance for the oscillatory motion to be produced.

The invention also relates to safety measures for the strand casting operation. Here we start with pressures caused by heating of the lift table and/or the strand casting mold, so that heat expansion forces might affect the rocking levers, the elastic supporting elements, and the draw rods. The invention provides that the pillow blocks are displaceable on the supporting frame in horizontal direction of the strand vein. This direction essentially corresponds to the direction of the casting strand, also if curved shape is projected onto a horizontal plane.

As a counter-measure to the solidification of a casting strand in the upper areas of the supporting roller stand, exerting pressures on its supporting elements, it is further provided that the supporting frame be displaceable along a guide extending in a horizontal plane in the direction of a curved vein. For safety reasons, it is also advisable that all assemblies of the oscillating gear, with the exception of the motor, are secured on the supporting frame. Usually the motor is affixed with a disconnect coupling at the series gear for the eccentric shafts, so that a heat expansion force effective in the strand vein direction and/or a force resulting from the contraction behaviour during the cooling of the cast strand, can easily be intercepted by loosening the coupling when displacing the supporting frame.

According to the invention, the starting basis for the interception of pressures from the support roller stand is the fact that consoles are provided on the supporting frame to accommodate the first group of strand support elements pertaining to a strand guiding arrangement following the strand casting mold. Pressures which may result from the contraction of the cast strand are now intercepted, according to the invention by providing on the console the bearing for the first group of strand support elements displaceable in the horizontal direction of the strand vein. An initial interception of heat expansion and/or heat contraction forces may therefore take place between the first group of strand support elements and the supporting frame for the assemblies of the oscillating gear.

In addition to the elastic support elements surrounding the articulated axle of the rocking levers, the supporting and/or rotary bearings of the two-arm rocking levers consist of elastic support elements which are rotary-elastically seated in sleeves. As far as the lift table together with the strand casting mold exerts heat expansion pressures on the rocking levers which can no longer be intercepted at the support points between the strand casting mold and/or the lift table carrying it, and the rocking levers, the supporting and/or rotary bearings of the two-arm rocking levers are also capable of receiving such pressures. Also, the articulated axle, the elastic support element, and the sleeve form an interchangeable structural unit.

The rotary elasticity of the elastic support elements is utilized to build an initial stress force acting against the weight force of the lift table and/or the strand casting mold, by installing the elastic support elements in the two-arm levers at least within the rotary bearings of the pillow blocks in operating position with a restoring or return force.

The invention further includes attaching to the strand casting mold and/or the lift table and the pillow block a flexible draft element, invariable in length, which is directed toward the center of curvature if the course of the strand is curved. This provides another means for increasing the accuracy of a curve guide during up and down swinging of the lift table together with the strand casting mold. Several of this type of draft elements may be provided. Another detail of the invention provides the flexible elements with initial stress, also to support the accuracy of the swinging movements.

It is also advantageous with respect to the accuracy of the vibration process that the flexible draft elements adhere at the end of the oscillating path to a roll-off surface adapted substantially to the bending line, in order to guarantee the desired distance from the center of curvature at any angle setting of the vibratory motion. The distance is in most cases the same. However, it may also assume a curved path deviating from the circular motion, according to the invention.

Examples of the invention are shown on the drawing and are explained as follows.

DETAILED DESCRIPTION OF THE INVENTION

Reference 1 stands for the strand casting mold and/or lift table which is mounted for swinging up and down movements. Depending on the respective size of the cast strand cross section, the weight of lift table 1 together with the strand casting mold (not shown) for slab cast strands amounts to 20 Mp. and more. In case the strand casting mold is arranged in the reciprocating oscillating apparatus without a lift table, the weights are reduced accordingly. The cast strand 2, whose center axis 2*a* in connection with the strand cross section, makes up the strand vein, is produced in the strand casting mold (lift table 1). Parallel with this strand vein 2*a*, the hollow of the mold is oscillated to loosen the strand, formed by solidification, from the mold wall.

Figure 1:
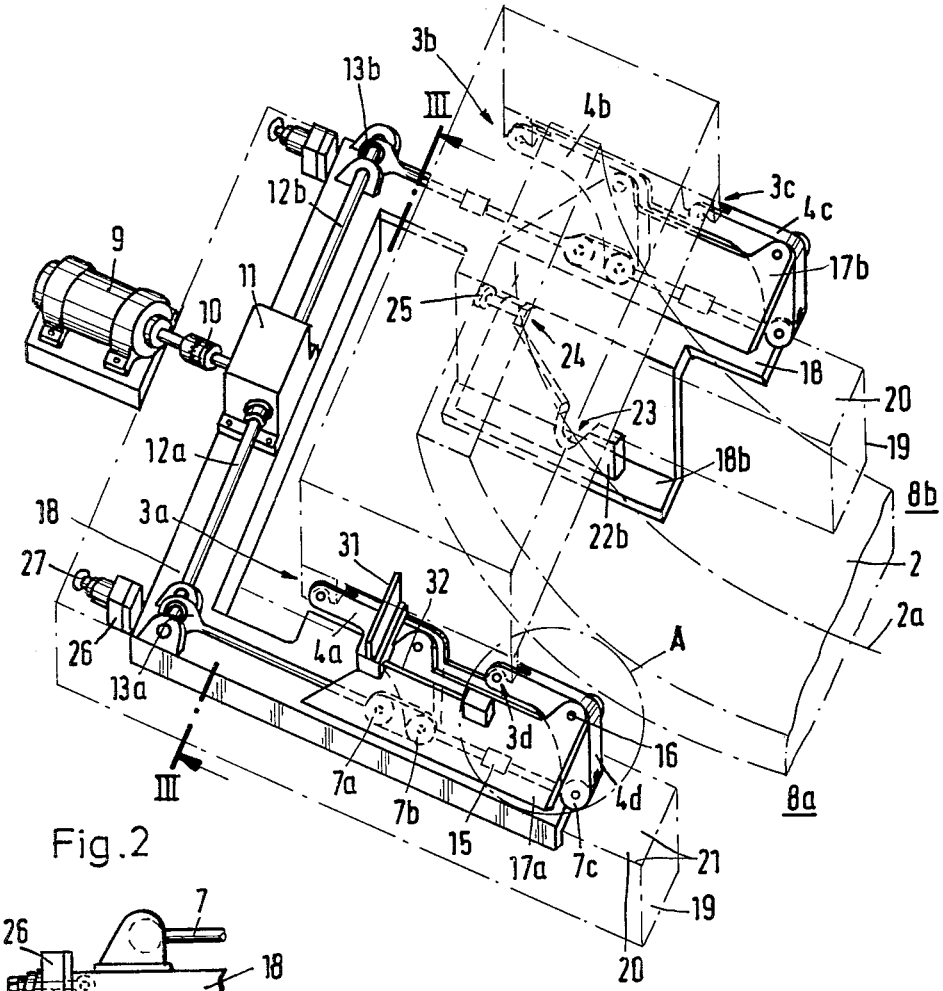
FIG. 1 is a view in perspective of apparatus illustrating the invention relative to a strand casting mold.
Figure 6:
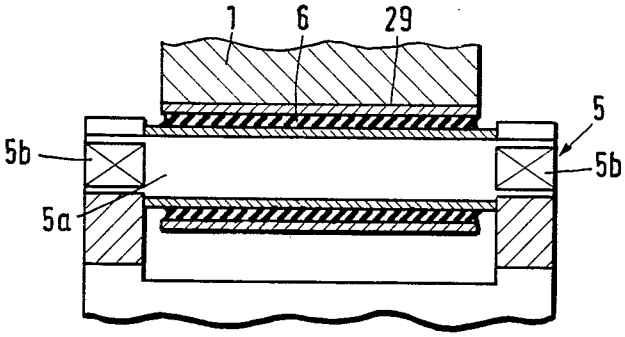
FIG. 6 is a vertical sectional view, enlarged, of the resilient rotary bearing mounts of the invention for a strand casting mold or lift table.
Figure 7:
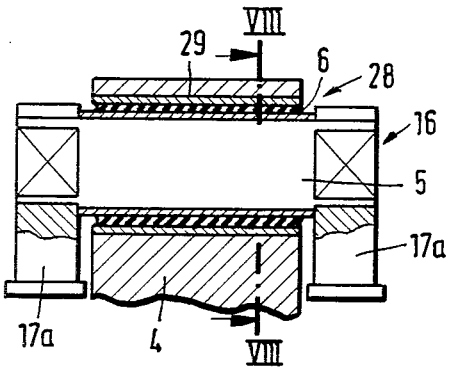
FIG. 7 is a vertical sectional view, enlarged, of the resilient rotary bearing mounts of the rocking levers of the invention.
Figure 8:
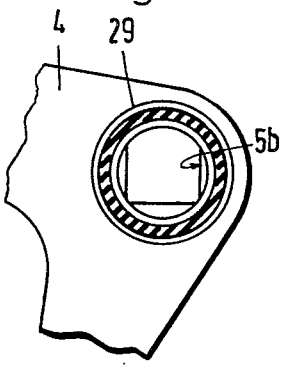
FIG. 8 is a sectional view along lines VIII—VIII of FIG. 7.

The lift table 1 (and/or strand casting mold) rests on the support points 3*a*, 3*b*, 3*c*, 3*d* by means of rocking levers 4*a*, 4*b*, 4*c*, 4*d* (FIG. 1). The articulated axle of each rocking lever 4 is surrounded by elastic or resilient support elements 6, wherein elastic materials such as, for example, different types of rubber or rubber mixtures, which may have metal particles imbedded, may be utilized. The material is of limited elasticity and at the same time absorbs vibrations. With increasing stress on the support points 3 the material of limited elasticity is chosen to be less elastic (FIG. 6). In the example shown, the rocking levers 4 consist of angle levers. Two elongated two-arm levers could be used. In this case, only the arrangement of draw and/or thrust rods 7 is changed. The draw and/or thrust rods 7 each connect two rocking levers 4 on each side of the two strand sides 8*a*, 8*b*.

Aligned with the direction of the strand vein 2*a*, the rocker gear motor 9 rests on a part of the strand casting plant which is not shown in detail. Motor 9 drives, via the shear coupling 10, the series gear 11 which is the starting point for the symmetrical eccentric shafts 12*a* and 12*b*. The draw and/or thrust rods 7 are hinged to the eccentrics 13*a* and 13*b* on shafts 12*a*, 12*b* and are connected to the pairs of rocking levers 4 at the opposite end.

Figure 9:
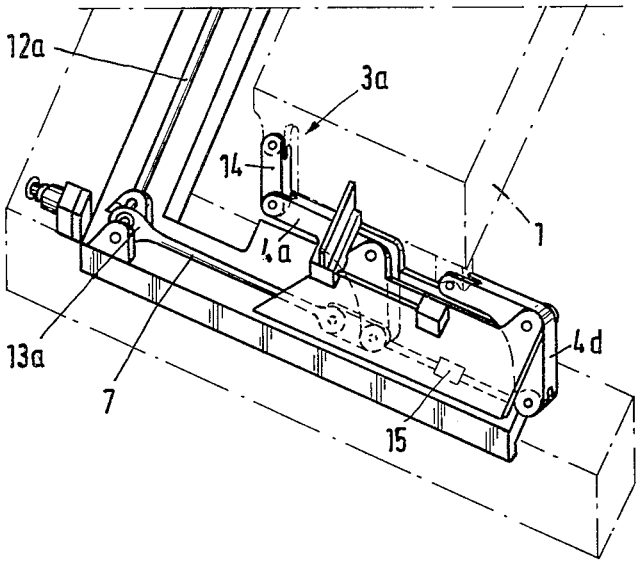
FIG. 9 is a partial perspective view of apparatus similar to that of FIG. 1, showing a further embodiment of mounting for the rocking levers of the invention.
Figure 10:
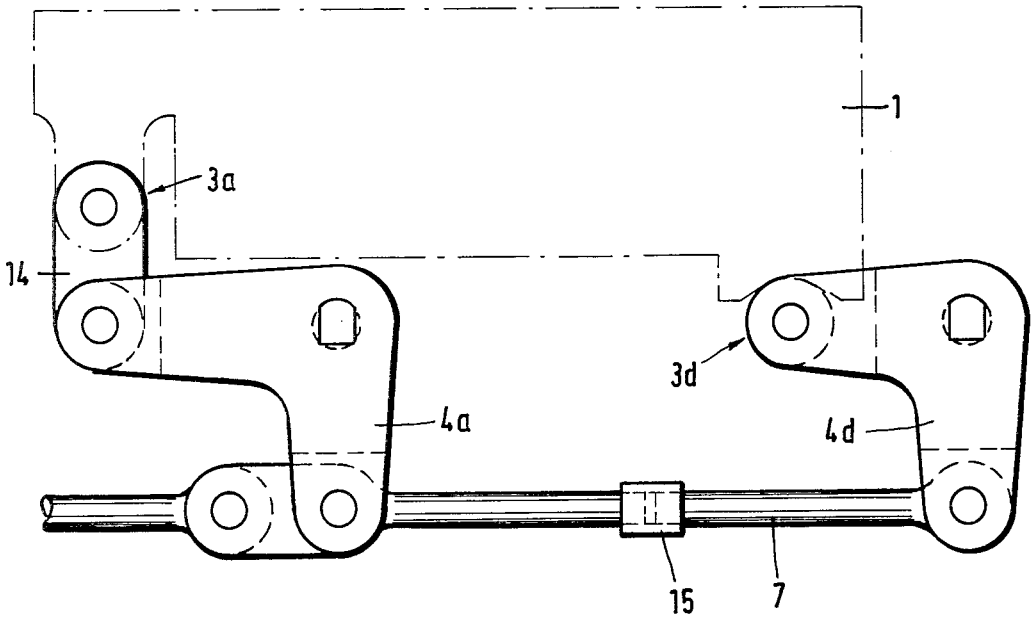
FIG. 10 is an enlarged detailed side elevational view of a portion of the apparatus of FIG. 9.

FIG. 9 shows a different embodiment of the invention from FIG. 1. In order to eliminate pressures caused by differential lengths of the lever pairs 4*a*/4*b* and 4*c*/4*d*, as well as by heat expansion of the lift table, an additional lever 14 is provided as a link between the lift table 1 and the support points 3*a*, 3*b*, 3*c*, 3*d*.

The thrust rods 7 have pivot joints 7*a*, 7*b* and 7*c* and may, as shown, be divided into several sections or connected continuously to two rocking levers 4 with the pivot joints. A length setting by means of a turnbuckle 15 is inserted for the rods 7 provided on both strand sides 8*a*, 8*b*. The rocking levers 4 rest in the pillow blocks 17*a* and 17*b* by means of rotary axes 16. The pillow blocks 17 extend along the rocking levers 4 longitudinally. A common supporting frame 18 resting on the scaffold 19 of the strand casting plant serves as a base for pillow blocks 17*a*, 17*b*. The pillow blocks 17*a* and 17*b* are displaceable on rail guides, not shown in detail, in the direction of the strand vein 2*a*, however, within a horizontal plane 20 and fixable in this position. The scaffold 19 forms a guide 21 for the supporting frame 18 with its edges, in horizontal plane 20. The supporting frame 18 carries all parts of the oscillating assembly including rocking levers 4, pedestals 17, thrust rods 7, series gear 11, with the exception of the rocker gear motor 9. A sufficiently rigid supporting frame 18 contributes to the accuracy of the rocking lever 4 bearing and thus to the accuracy of the oscillatory path.

Attached on the supporting frame 18 are also integral horizontal brackets 18*a*, 18*b*, on each side of the strand 8*a*, 8*b*, and symmetric with the strand vein 2*a*. Brackets 18*a*, 18*b* are bearing surfaces for suspension trays 22*a*, 22*b*, respectively, having receiving slots 23 and stops 24 for the first group of strand supporting elements (not shown) following the strand casting mold 1. The trays 22 are displaceable along the usual rail guides connected to the console 18, whereby the length of movement of a spring-loaded support 25 is sufficient to yield to the contracting forces of the solidifying cast strand 2.

Figure 2:
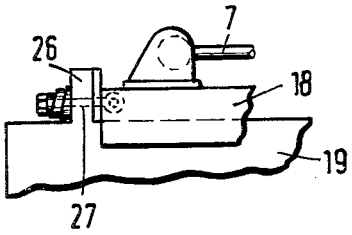
FIG. 2 is an enlarged side elevational view of a portion of the apparatus of FIG. 1, showing in detail the displaceable stop for the support frame.
Figure 3:
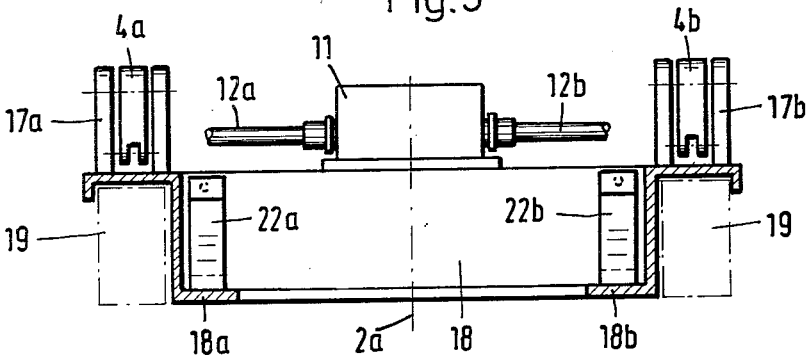
FIG. 3 is a sectional view along lines III—III of FIG. 1.
Figure 4:
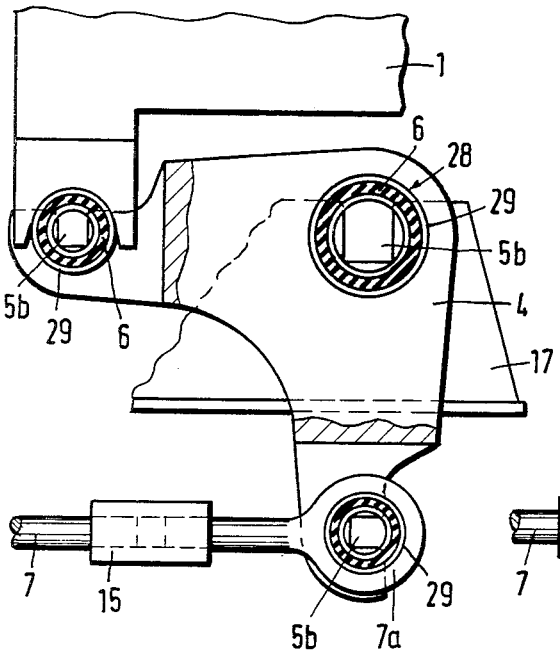
FIG. 4 is an enlarged view of a portion of the apparatus of FIG. 1 in the circle marked A.
Figure 5:
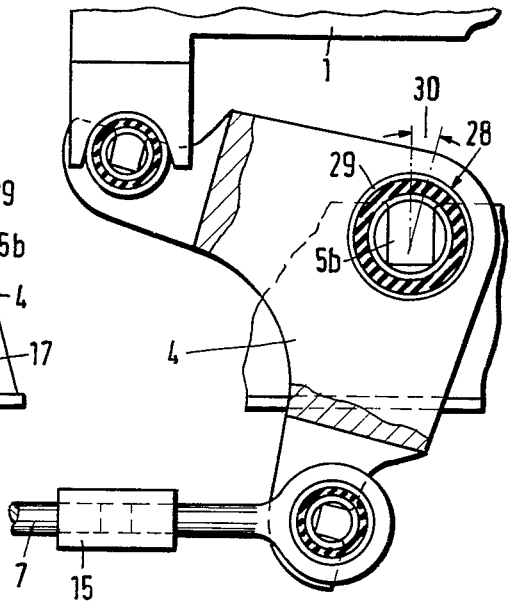
FIG. 5 is a view of the apparatus of FIG. 4 in a different position of movement when the lift table is moving upward.

In similar manner, the supporting frame 18 is secured against thermal forces coming from the cast strand 2 by means of a stop 26 and a spring-loaded connection 27 (FIG. 2). When expansion and/or contraction forces occur, either the supporting frame 18 and/or the bearing 22 are pulled away from the respective stops without resistance. This safety device prevents damage to any assemblies of the oscillating gear. Further elasticity of the system results from the resilient supporting elements 6 (FIGS. 4 through 8). The support and/or rotary bearing 16 for the rocking levers 4 consist of articulated axles 5 with the resilient supporting elements 6, which are received in sleeves 29 around the shaft 5*a*. The "give" of this structural part affects the articulated axle 5 radially, axially, and spatially. Furthermore, there is a torsion force between the articulated axle 5 and sleeve 29, which are inserted under the angle 30 (FIG. 5) by means of flattened (bevelled) articulated axle pins 5*b* (marked by a cross in FIGS. 6 and 7), so that stress by the lift table 1 causes a relaxing of the resilient supporting element 6 under initial stress. This measure results in an absolutely free-of-play power transmission path within the oscillating gear.

Extension 31 (FIG. 1) is attached to lift table 1, and to pillow block 17 is attached a flexible draft element 32, invariable in length, which is directed towards the center of curvature of the plant in curved strand casting plants. Such draft elements are arranged in pairs 32 and balance deviations, resulting from lever pairs 4*a*/4*b* and/or 4*c*/4*d* of uneven length. An exact guide of the flexible draft elements can be achieved by roll-off surfaces (not shown) formed in accordance with the shape of the oscillatory path.

I claim:

1. Apparatus for reciprocating a strand casting mold lift table, comprising (a) a guide for said apparatus positioned parallel to the cast strand path;

(b) motor means for reciprocating said apparatus;

(c) a pair of bearing support points for said table extending from the bottom of each side of said table;

the improvement characterized by (d) a rocker lever connected to each said bearing point;

(e) an articulated axle between each said bearing point and its respective rocker lever;

(f) an annular resilient support element surrounding each said axle;

(g) a thrust rod on each side of said table;

(h) one end of each said thrust rod connected to said pair of rocker levers on its respective side of said table;

(i) eccentric drive means extending from said motor means to each side of said table; and (j) the end of each said thrust rod opposite said pair of rocker levers connected to said eccentric drive means.

2. The apparatus of claim 1, further characterized by (a) vertical lever means extending between said table and one of said pair of rocker levers on each side of said table.

3. The apparatus of claim 1, further characterized by (a) each said rocker lever is a bell crank.

4. The apparatus of claim 1, further characterized by (a) the horizontal extent of the opposed rocker levers one of each pair on opposite sides of said table is equal; and (b) the said horizontal extent of each opposed pair is of different length from the other opposed pair.

5. The apparatus of claim 1, further characterized by (a) means in each said thrust rod for adjusting the length thereof.

6. The apparatus of claim 1, further characterized by (a) pivot means between each said thrust rod and its respective rocker levers; and (b) said pivot means includes an annular resilient support element.

7. The apparatus of claim 5, further characterized by (a) said length adjusting means is a turnbuckle.

8. The apparatus of claim 1, further characterized by (a) a support frame;

(b) a pillow block disposed on said support frame on each side of said table;

(c) each pair of rocker levers on one side of said table pivoted on its respective pillow block.

9. The apparatus of claim 8, further characterized by (a) each said pillow block is displaceable on said support frame in a direction parallel to said cast strand path.

10. The apparatus of claim 9, further characterized by (a) a guide surface extending in a horizontal plane parallel to said cast strand path; and (b) said support frame displaceable on said guide surface.

11. The apparatus of claim 10, further characterized by (a) all said reciprocating apparatus supported on said support frame with the exception of said motor means.

12. The apparatus of claim 8, further characterized by (a) opposed integral horizontal support brackets extending toward each other on said support frame; and (b) support bearings for the initial support elements of said cast strand supported on said opposed brackets.

13. The apparatus of claim 6, further characterized by
(a) an annular sleeve surrounding each said annular resilient support element in each said rocker lever.

14. The apparatus of claim 1, further characterized by
(a) said annular resilient support elements are positioned under initial stress when installed.

15. The apparatus of claim 8, further characterized by
(a) an elongated flexible draft element on each side of said table;
(b) said draft element extending between said table and their respective pillow blocks; and
(c) said draft elements being of fixed length.

16. The apparatus of claim 15, further characterized by
(a) said draft elements connected under initial stress.

17. The apparatus of claim 15, further characterized by
(a) said draft elements directed toward the center of curvature of a curved strand path.

18. The apparatus of claim 15, further characterized by
(a) said draft elements connected to their respective said pillow blocks to be positioned in the bending line at the end of the path of reciprocation.

* * * * *